United States Patent [19]

Lamb

[11] 3,986,943

[45] Oct. 19, 1976

[54] HYDROMETALLURGICAL PROCESS FOR THE PRODUCTION OF ANTIMONY

[75] Inventor: Frank E. Lamb, Tucson, Ariz.

[73] Assignee: Duval Corporation, Houston, Tex.

[22] Filed: May 27, 1975

[21] Appl. No.: 581,207

[52] U.S. Cl. ..... 204/105 R; 204/128

[51] Int. Cl.[2] ..... C25C 1/22; C25B 1/00; C25B 1/26

[58] Field of Search ..... 204/105 R, 128, 98; 75/104

[56] References Cited

UNITED STATES PATENTS

| | | | |
|---|---|---|---|
| 2,331,395 | 10/1943 | Holmes | 75/101 R |
| 3,108,934 | 10/1963 | Beau | 204/105 R |
| 3,755,106 | 8/1973 | Scheiner et al. | 204/105 R |

*Primary Examiner*—R. L. Andrews
*Attorney, Agent, or Firm*—Delmar L. Sroufe

[57] ABSTRACT

A hydrometallurgical process for pollution-free recovery of metallic antimony from stibnite and other antimony-containing materials by (a) reduction of ferric chloride by such materials to produce ferric chloride and antimony (III) chloride, (b) recovery of metallic antimony, preferably by electrolysis, (c) regeneration of the ferric chloride, and (d) purge of impurities. Optionally, the metallic antimony thus produced may be subsequently oxidized if desired to produce high purity antimony oxide. The process is amenable to cyclical operation.

45 Claims, 6 Drawing Figures

*ACTUALLY PASSES THROUGH DIAPHRAGM TO ANOLYTE UPON FORMATION

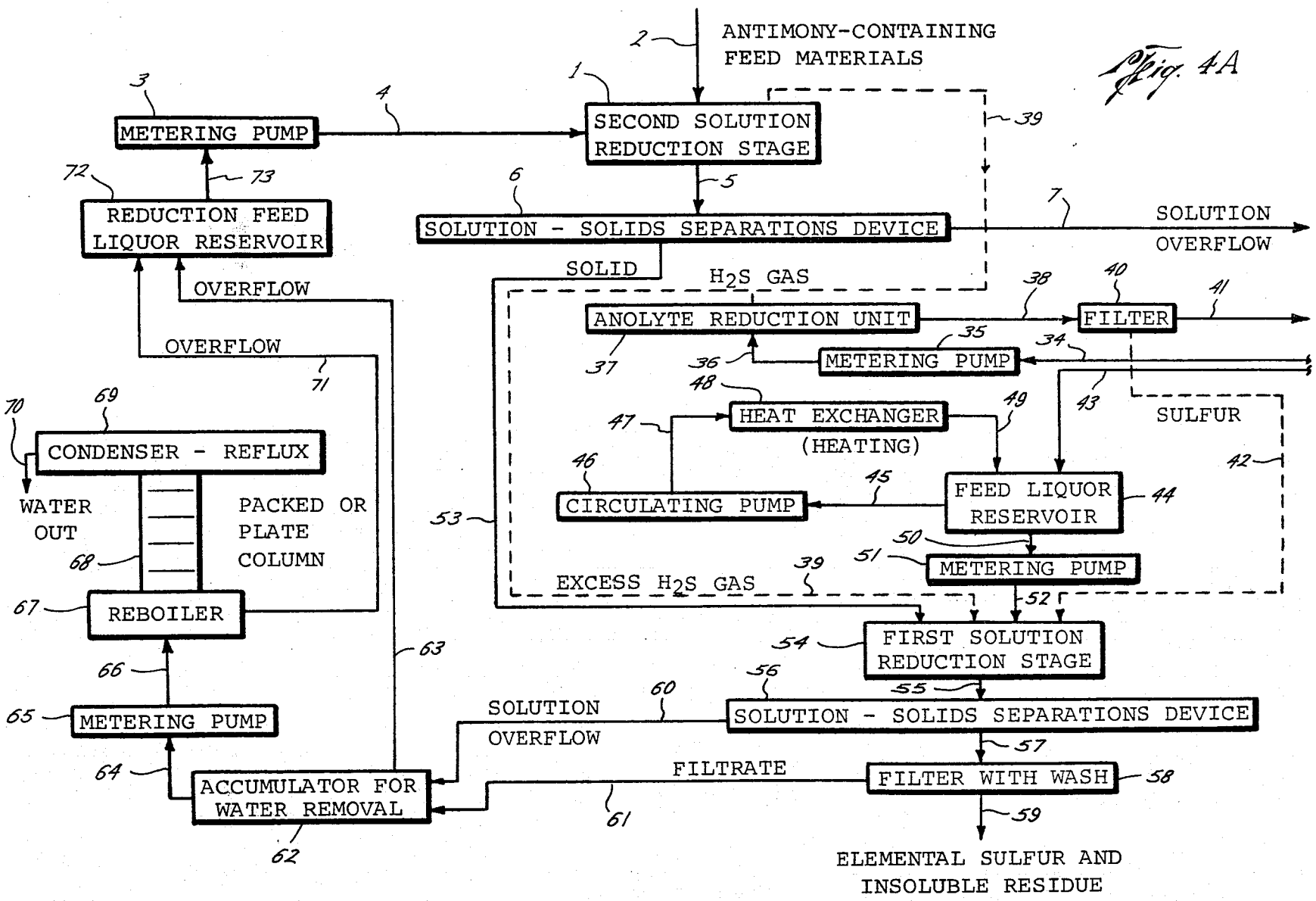
Fig. 4A
ANTIMONY-CONTAINING FEED MATERIALS
SECOND SOLUTION REDUCTION STAGE
METERING PUMP
SOLUTION - SOLIDS SEPARATIONS DEVICE
SOLUTION OVERFLOW
SOLID
H2S GAS
ANOLYTE REDUCTION UNIT
FILTER
METERING PUMP
HEAT EXCHANGER (HEATING)
CIRCULATING PUMP
SULFUR
FEED LIQUOR RESERVOIR
METERING PUMP
EXCESS H2S GAS
FIRST SOLUTION REDUCTION STAGE
SOLUTION - SOLIDS SEPARATIONS DEVICE
FILTER WITH WASH
ELEMENTAL SULFUR AND INSOLUBLE RESIDUE
FILTRATE
SOLUTION OVERFLOW
ACCUMULATOR FOR WATER REMOVAL
METERING PUMP
REBOILER
PACKED OR PLATE COLUMN
CONDENSER - REFLUX
WATER OUT
OVERFLOW
OVERFLOW
REDUCTION FEED LIQUOR RESERVOIR
METERING PUMP

HYDROMETALLURGICAL PROCESS FOR THE PRODUCTION OF ANTIMONY

BACKGROUND OF THE INVENTION AND PRIOR ART

The most important source of antimony is ores containing the mineral stibnite, antimony trisulfide ($Sb_2S_3$). In deposits where stibnite has been exposed to oxidation, a number of oxide minerals may be formed; these include stibiconite ($Sb_3O_6(OH)$), cervantite ($Sb_2O_4$ or $Sb_2O_3 — Sb_2O_5$), valentenite ($Sb_2O_3$), senarmonite ($Sb_2O_3$), and kermasite ($2\ Sb_2S_3 — Sb_2O_3$) an oxysulfide. Occasionally, native metallic antimony is also found associated with these deposits.

Conventionally, metallic antimony is recovered from these materials or from concentrates prepared therefrom by iron precipitation, direct smelting, or by smelting of oxides formed by roasting thereof. The choice of the pyrometallurgical process steps selected is dictated by the characteristics and quality of the feedstock available and the product(s) desired. The application of any of these pyrometallurgical processes in the production of metallic antimony or high grade antimony oxide results in atmospheric pollution and substantial direct loss of contained antimony.

Pollutants introduced into the atmosphere include suspended paticulates, volatilized antimony trioxide, and gaseous oxides of sulfur. Of these air contaminants, it has been found that the sulfur oxides are the most difficult to control. Meeting existing and proposed air quality control regulations and standards, therefore, is becoming increasingly difficult. The process disclosed herein involves the production of no gaseous discharge stream; hence none of the above-enumerated problems are encountered or involved. The enhanced recovery of the antimony from the processed ore and the elimination of atmospheric-pollutants are readily apparent advantages of this process.

Additionally, substantial losses of antimony content in solid residues, such as liquation residues and slags, of pyrometallurgical processes is generally encountered when these techniques are practiced. Laboratory data obtained for reactions in the process herein disclosed indicate that recoveries between 95 and 100 percent of the contained antimony content in the feedstock are reasonable and practical.

Various attempts have been made in the prior art to devise a successful commercial hydrometallurgical process for producing metallic antimony.

While the desirable characteristics of an economically feasible hydrometallurgical process have long been recognized, the successful development of a commercial process has eluded the prior at. Attempts at developing a commercial process utilizing a ferric chloride as a lixiviant for antimony are disclosed in Bonneville, British Pat. No. 2203 (1870); Butterfield, British Pat. No. 9052 (1896); and Tugov, "Hydrometallurgical Method for Obtaining Metallic Antimony from Concentrates," International Chemical Engineering, V: 1, pp. 5 – 8 (January, 1965).

The Butterfield patent and the Tugov article were expressly concerned with recovery of metallic antimony, but the methods disclosed in both references are unsatisfactory commercially because of their requirement of the use of scrap iron to precipitate the metallic antimony from the antimony chloride solution. This requirement, with the waste products attendant to antimony precipitation with scrap iron, makes these previously described processes commercially impractical and undesirable.

Holmes, U.S. Pat. No. 2,331,395 (1943), discloses an electrolytic hydrometallurgical process for the production of metallic antimony. However, the Holmes process requires the systematic addition of caustic soda (sodium hydroxide) to the process, and produces certain barium salts as an undesirable by-product (which are regenerated as a necessary reactant by a heating process); whereas the process disclosed herein completely regenerates its solutions for some antimony-containing materials, and produces elemental sulfur (which may be removed and sold) as its by-product. Further more, the Holmes process is based upon an alkaline sulfide leaching solution (particularly sodium sulfide), whereas the process disclosed herein is based upon a ferric chloride leaching solution.

SUMMARY OF THE INVENTION

The object of the prsent invention is to provide a hydrometallurgical process for the extraction of metalic antimony from antimony-containing materials, whereby the pollution effects of conventional pyrometallurgical processes are avoided, and yet such process is competitive with the conventional pyrometallurgical processes. The present invention contemplates essentially complete dissolution of the contained antimony, production of electrolytic grade metallic antimony, regeneration of reagents, and removal of impurities from the process solutions. Other objects and advantages of the present invention will appear from the following descriptions, examples, and claims.

It has been discovered that these objectives can be accomplished by use of a process having four basic stages which can be briefly described as two solution reduction stages, a metal recovery stage, and a solution regeneration stage. A fifth stage, metal oxidation, is added to obtain an antimony oxide product from the produced metal if desired.

In the first solution present stage, partially leached reacted antimony-containing materials are contacted with a solution metallic hydrochloric acid, ferric chloride, and antimony (III) chloride ($SbCl_3$). The resultant reduction of part of the ferric chloride results in the formation of a solution containing hydrochloric acid, ferrous chloride, ferric chloride, and additional amounts of antimony (III) chloride. An excess of ferric chloride and hydrochloric acid is provided to ensure virtually complete dissolution of the antimony. The time required for accomplishing essentially complete dissolution of the antimony is temperature dependent for a given particle size. In the case of antimony sulfide, most of the sulfur is not completely oxidized and can be recovered in elemental form.

In the second solution reduction stage, the ferric chloride in the solution from the first solution reduction stage is mostly reduced to ferrous chloride by the addition to the solution of antimony-containing materials. Concurrently a portion of the antimony content of the antimony-containing material is solubilized as antimony (III) chloride. To prevent hydrolysis of the antimony (III) chloride in solution, a suitable excess quantity of hydrochloric acid is included and maintained in the process solution throughout the process.

The metal recovery and solution regeneration stages are carried out in the cathode and anode sections respectively of a diaphragm-type cell. In the metal recovery stage, the antimony (III) chloride from the second solution reduction stage is electrolyzed to deposit metallic antimony at the cathode. The solution, now partially depleted of its antimony content, is passed to the anode section where the ferric chloride content is regenerated. The electrolysis is arranged so as to deposit at the cathode an amount of antimony equal to that dissolved into the process solution during the cycle, and preferably not the entire amount of antimony in the solution. Any additional oxidation requuired beyond that furnished by anodic reactions may be obtained by exposing the solution to air or oxygen either prior to introduction into the anolyte system of the electrolytic cell or after withdrawal therefrom, or both.

While it is possible to combine the two solution reduction stages, it has been found that satisfactory achievement of all the desired objectives is difficult and can be achieved only by very precise metering of reactants and by the use of extremely long reaction times.

Treatment of oxidized antimony compounds in the process gives rise to the necessity of providing for reduction in the solution regeneration stage unless the formation of chlorine gas is desirable. Such reduction can be provided by contacting the solution with a reducing gas such as hydrogen or hydrogen sulfide. If the latter is used, provision should be made for removal from the circulating stream of the sulfur formed by the reaction. The formation of chlorine ordinarily should be avoided since such formation would encourage oxidation of any sulfur species present to sulfate. However, if the chlorine gas is a desirable by-product of the process, additional reduction in the solution regeneration stage is not necessary. The removal of chlorine as a by-product of the process may require the addition of hydrochloric acid. The additional hydrochloric acid will be removed from the system in the form of the chlorine by-product and excess water.

Excess water in the circuit, whether formed by process reactions or introduced from external sources, may be removed by distillation to minimize dilution of the solution. Fractionation of the water vapor removed is required to permit recovery of any hydrogen chloride as a relatively concentrated solution so it can be returned to the circuit. Approximately one-quarter pound of water is formed for each pound of antimony metal derived from oxide in the feedstock. Other potential sources of water additions to the circuit include bound water with the feed materials, feedstock moisture, and that applied to wash the valuable process solution from solids residue when removed from the process. The concentrated process solution stream may also be advantageously used as a source of a bleed stream for purification or removal of unwanted soluble contaminants from the circuit.

BRIEF DESCRIPTION OF THE DRAWINGS

FIG. 4*a* and FIG. 4*b* is a detailed flowsheet showing one embodiment of the disclosed process.

DESCRIPTION OF PREFERRED EMBODIMENTS

Figure 1:
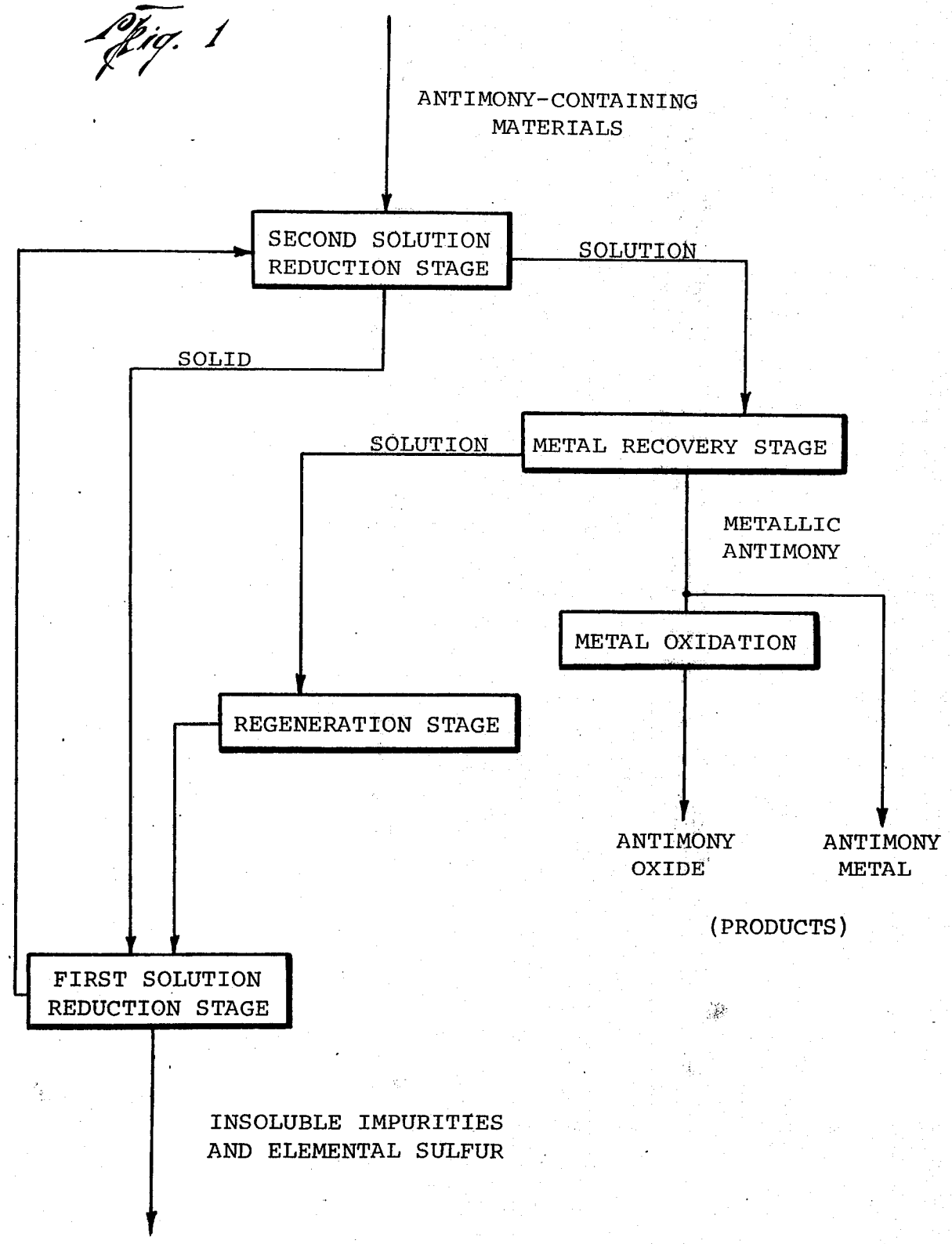
FIG. 1 presents a simplified flow diagram for treatment of antimony-containing materials.
Figure 2:
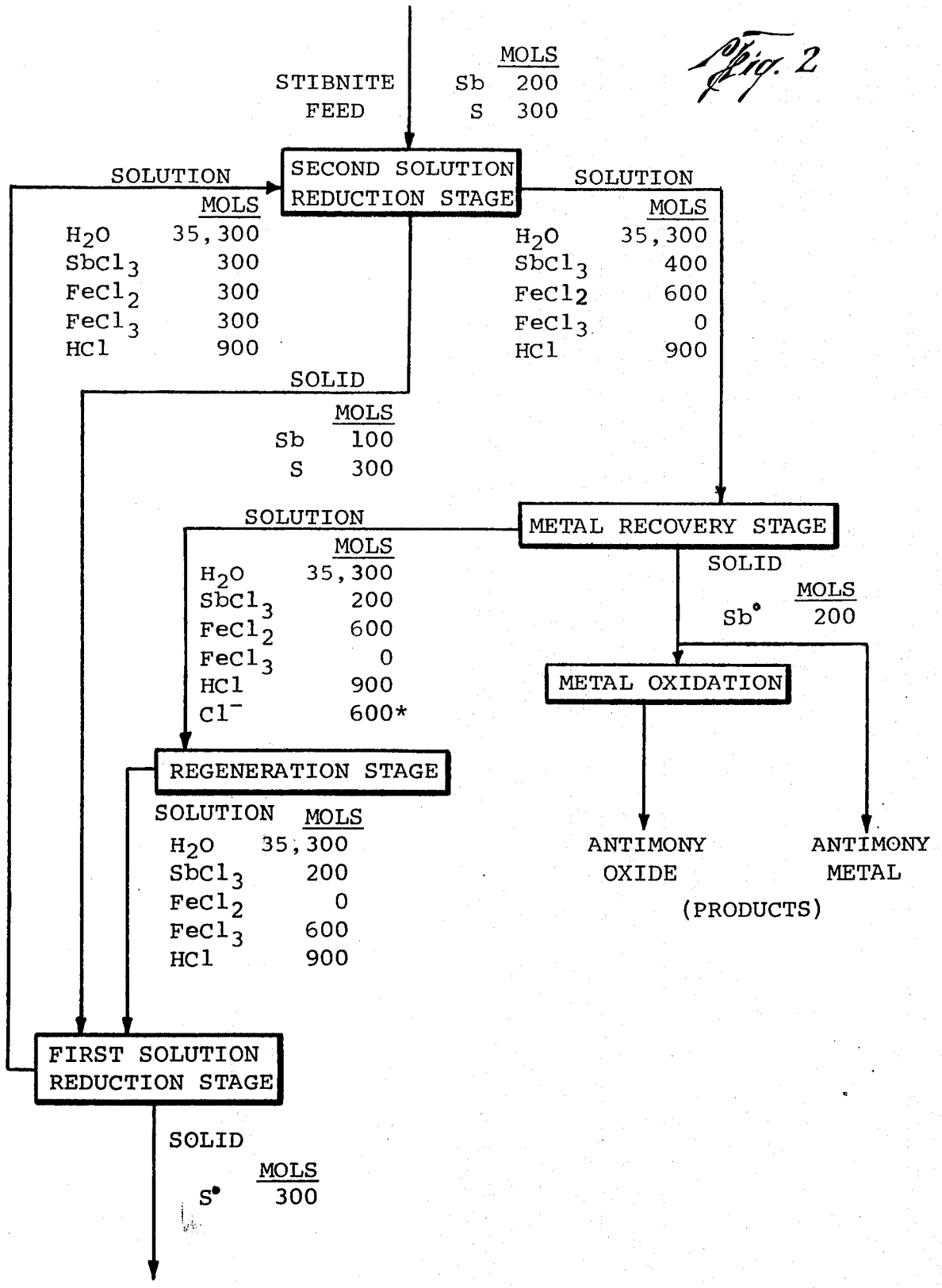
FIG. 2 diagrammatically presents a stoichiometric molar balance illustrating the basic chemistry of the process as applied to stibnite.
Figure 3:
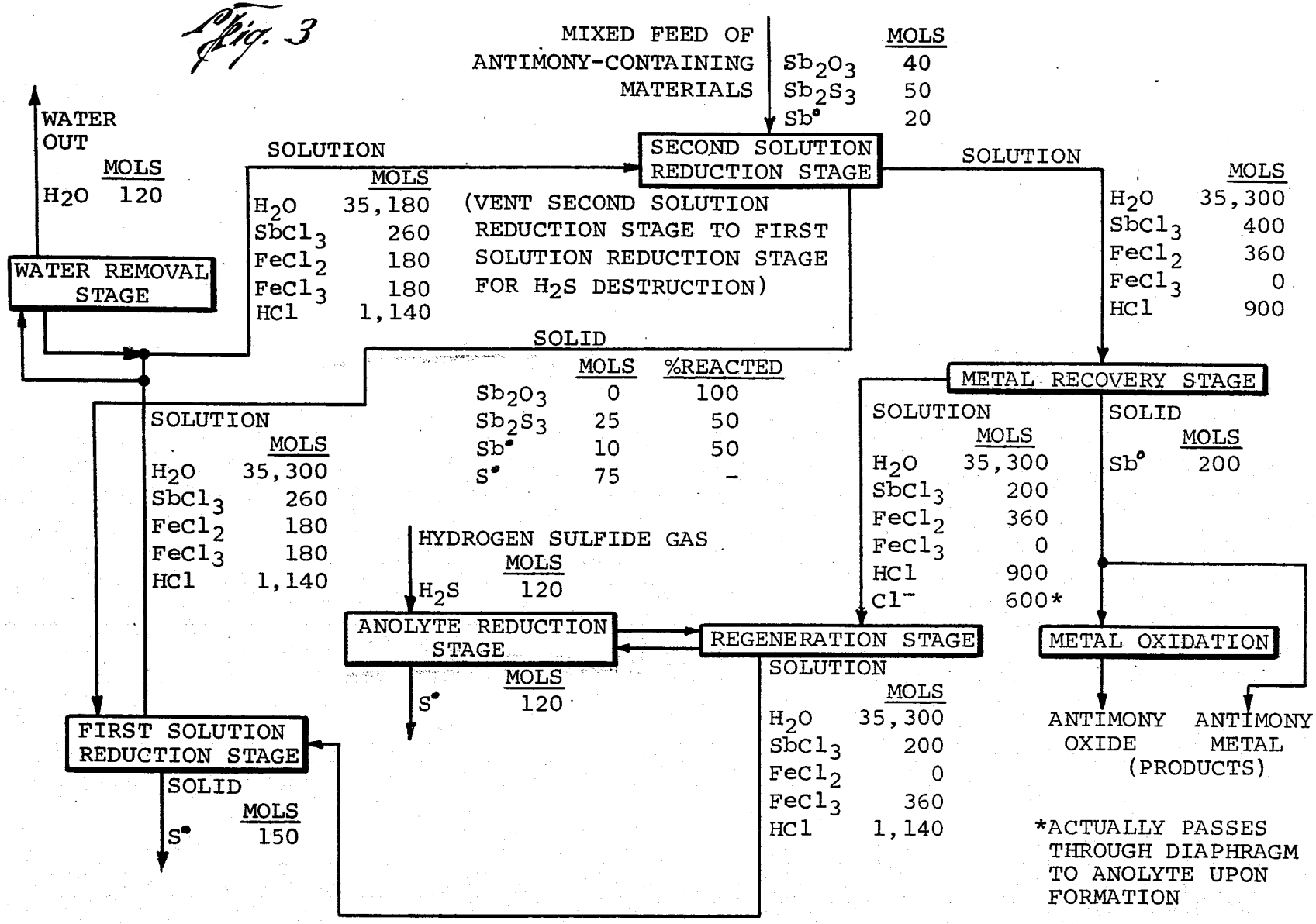
FIG. 3 diagrammatically presents a stoichiometric molar balance illustrating the basic chemistry of the process as applied to a mixed feed containing antimony metal, oxide, and sulfide.

The simplified basic process for the treatment of antimony-containing material will be readily understood from the diagram of FIG. 1. The basic chemistry of the process is illustrated by the stoichiometric molar balance of FIG. 2 as applied to stibnite and of FIG. 3 as applied to a mixture of antimony metal, oxide, and sulfide. The principal reactions occurring for various minerals in the ore concentrates in the reduction stages of the process are presently believed to be as follows:

1. Antimony metal $$Sb^0 + 3FeCl_3 \rightarrow SbCl_3 + 3FeCl_2$$

2. Antimony sulfide (Stibnite)

$$Sb_2S_3 + 6FeCl_3 \rightarrow 2SbCl_3 + 6FeCl_2 + 3S^0$$

$$Sb_2S_3 + 6HCl \rightarrow 2SbCl_3 + 3H_2S$$

3. Antimony Oxide (Senarmontite)

$$Sb_2O_3 + 6HCl \rightarrow 2SbCl_3 + 3H_2O$$

4. Antimony Oxide (Stibconite)

$$Sb_3O_6OH + 13HCl + 4FeCl_2 \rightarrow 3SbCl_3 + 4FeCl_3 + 7H_2O.$$

Figure 4B:
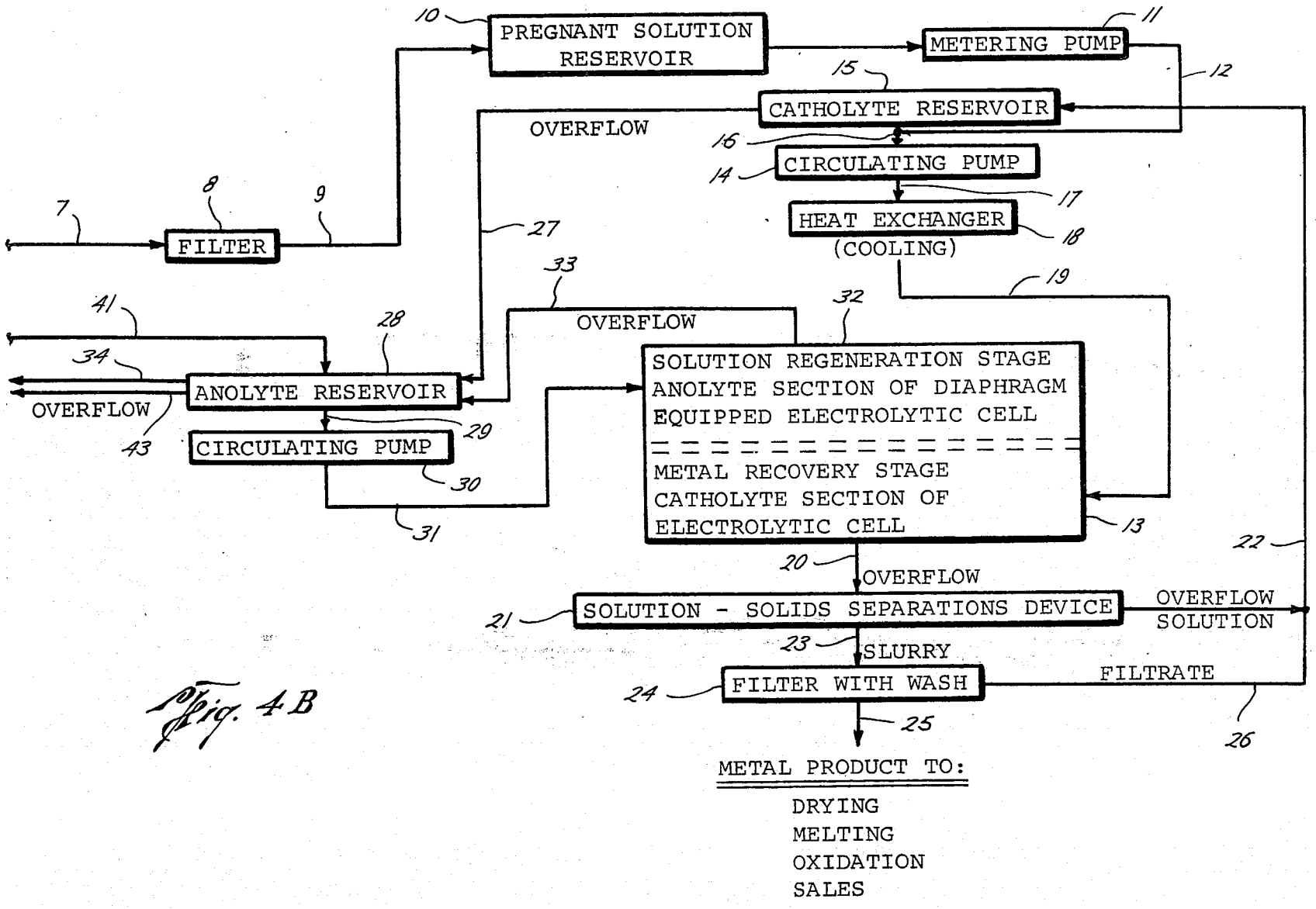

For a more complete description of the preferred embodiments, however, reference should be made to FIG. 4 and the following description.

In the treatment of antimony ore concentrates comprised principally of sulfide, together with some oxides and metal the fresh ore concentrates are added to a reduction stage in which they are contacted with a partially reduced solution. This reduction stage is herein referred to as the "second solution reduction stage" and it is indicated by numeral 1 (FIG. 4). The fresh ore concentrates are introduced into the second solution reduction stage 1 through line 2. As used herein "fresh" or "raw" refers to antimony-containing materials not previously reacted with any reagents in the process. Ferric chloride, along with antimony (III) chloride, ferrous chloride, and hydrochloric acid are introduced into the second solution reduction stage 1 by metering pump 3 through line 4. In the second solution reduction stage 1, which is essentially closed to the atmosphere, the ferric chloride in the solution is substantially reduced to ferrous chloride by reaction with the sulfide ore concentrates at near atmosphere boiling, about 105° C. The oxide components of the fresh ore concentrates react with the excess hydrochloric acid present to form antimony (III) chloride and water. The process may be operated in such a manner as to produce hydrogen sulfide gas, if desired, by taking advantage of the reaction between the antimony sulfide and a portion of the excess hydrochloric acid. The hydrogen sulfide gas may be used subsequently in the anolyte reduction step or destroyed by reaction with ferric chloride in the first solution reduction stage 54. In any event, operation of the process in such a manner as to produce a controlled amount of hydrogen sulfide gas in the second solution reduction stage 1 insures a high degree of reduction of ferric chloride to ferrous chloride, and it is preferable that said reduction be substantially complete to minimize the power to the electrolytic cell ncessary to deposit the antimony.

The partially reacted ore concentrates, as well as the solution containing essentially ferrous chloride, antimony (III) chloride, and hydrochloric acid, are passed through line 5 to solution-solids separations device 6, where the solids are separated from the solution by gravity sedimentation.

Arsenic contamination may be introduced into the solution by the arsenic content of the ore concentrates. If a high degree of purity of the deposited antimony is necessary or desirable, then the arsenic must be removed from the solution prior to introduction into the catholyte section of the electrolytic cell. This can be done by a modification of the second solution reduction stage 1.

The introduction of hydrogen sulfide ($H_2S$) into the arsenic containing solution will precipitate the arsenic as a sulfide. The precipitate may then be separated from the solution by sedimentation, filtering, or other appropriate means, and removed.

The arsenic removal may be accomplished by treating a bleed stream from the second solution reduction stage 1. Hydrogen sulfide gas can be introduced into the bleed stream, wherein the arsenic will be precipitated as a sulfide, and removed.

Figure 5:
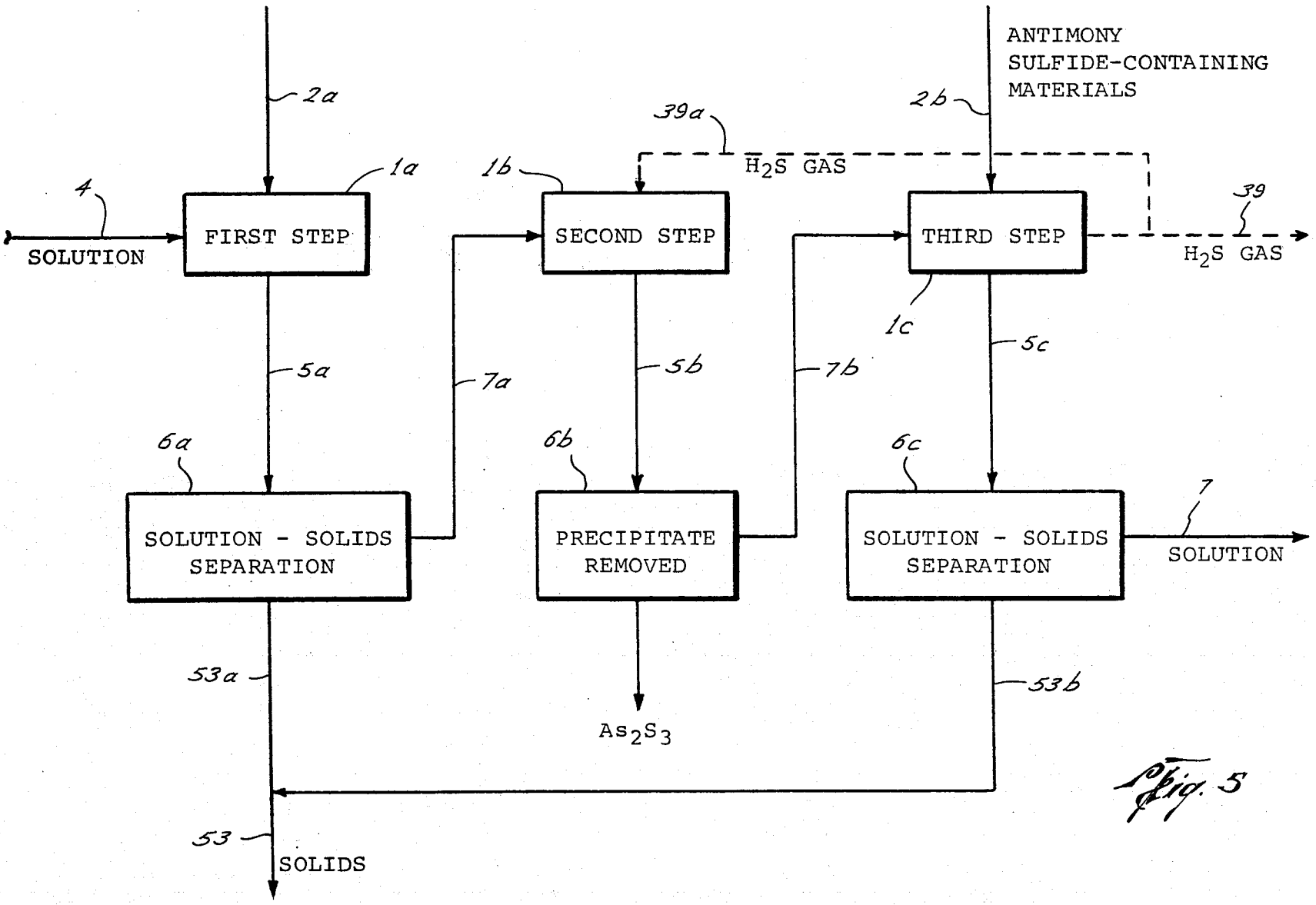
FIG. 5 is a detailed flowsheet showing an embodiment in which the second reduction stage is conducted in three steps.

Alternatively, as shown in FIG. 5, the second solution reduction stage 1 may be broken into three steps. In the first step, a portion of the fresh ore concentrates, metallic antimony, or other antimony containing materials are introducted into container 1*a* through conduit 2*a* where they are contacted with the incoming partially reduced solution. The ferric chloride in the solution is substantially reduced to ferrous chloride, but the reactions are not allowed to continue to the point where hydrogen sulfide gas is generated. The solution is separated from the solids by separator 6*a* and then passed through line 7*a* to a second container 1*b* for the second step of the second reduction stage. In the second step, hydrogen sulfide gas (generated by the third step) is reacted with the reduced solution in the second container to completely reduce the ferric chloride to ferrous chloride and to precipitate the arsenic as a sulfide. The precipitate may then be separated by separator means 6*b* from the solution by sedimentation, filtering, or other appropriate means, and removed. The reduced solution, stripped of the arsenic precipitate, is passed through line 7*b* to a third container 1*c*. In the third step, additional antimony sulfide containing materials are introduced through line 2*b* into container 1*c* in quantities in excess of the amount required to reduce essentially all of the ferric chloride in the third container to ferrous chloride. The excess antimony-containing materials then react with the hydrochloric acid in the solution in the third container to produce hydrogen sulfide gas. This gas may be passed through line 39*a* to be used in the second step immediately preceding, and/or the hydrogen sulfide gas may be passed through line 39 to be used in the anolyte reduction step or first solution reduction stage 54 as discussed herein.

The solution from separator 6, or 6*c* of FIG. 5, containing essentially ferrous chloride, antimony (III) chloride, and hydrochloric acid, is then passed through line 7 to filter 8. This filter serves to entrap and remove from the solution any suspended particulate matter which may be contained in the solution exiting separator 6. This clarification is desirable since any particulates passing into the metal recovery stage could serve as a source of contamination of the metal product. The filtered electrolyte solution then passes through line 9 to pregnant solution reservoir 10 where it is stored prior to introduction into the metal recovery stage. Metal recovery is achieved by electrolysis wherein the basic reaction in the catholyte compartment is:

$$Sb^{+3} + 3e \rightarrow Sb^{0}.$$

Metering pump 11 introduces the pregnant liquor into the circulating catholyte stream in the catholyte sections of the electrolytic cells. In these portions of the electrolytic cells, which are partitioned from the anolyte sections with diaphragms, the antimony (III) chloride is electrolyzed to deposit metallic antimony at the cathodes by the reaction indicated above. The antimony metal may be deposited as individual cathodes for intermittent withdrawal or in the form of electrolytic granules, or powder for continuous withdrawal. To provide agitation and displacement of the solution in contact with the surface of the cathode in order to promote the desired type of antimony deposition, positive circulation of the catholyte solution is maintained by circulating pump 14. Recycling catholyte solution from catholyte reservoir 15 enters the pump suction through line 16, fresh feed liquor joins this stream through line 12. Temperature control in the catholyte circulating system is maintained by heat exchanger 18 through which a portion or all of the catholyte stream passes prior to entering the catholyte section of the elctrolytic cell through line 19. Since the second solution reduction stage 1 is preferably operated at near the atmospheric boiling point, the catholyte solution may require cooling before being allowed to enter the electrolytic cell. The product slurry containing metallic antimony particles suspended in the catholyte solution leaves the catholyte section of the electrolytic cell and is passed through line 20 to solution-solids separations device 21, where the metallic antimony solids are separated from the solution by any desired means, such as gravity sedimentation. The solution overflows the solution-solids separations device and passes through line 2 to catholyte reservoir 15.

The metallic antimony solids, together with some solution, pass from solution-solids separations device 21 through line 23 to washing filter 24, where the catholyte solution is removed. The filtrate and wash solutions are returned to the catholyte reservoir 15 through line 26. The cleaned and washed metallic antimony solids leave the washing filter device through line 25. This electrolytic antimony metal is of high purity, and may be converted into other products if desired.

Excess catholyte, approximately equal in volume to the amount of pregnant liquor and wash water introduced into the catholyte section of the electrolytic cell, leaves catholyte reservoir 15 through overflow line 27 and enters anolyte reservoir 28. Regeneration of the solution is accomplished by oxidation of the ferrous chloride to ferric chloride in the anolyte section of the diaphragm-equipped electrolytic cell. Here, an electrolytic reaction, concurrently induced with the reaction in the cathode reaction, occurs:

$$3Fe^{+2} \rightarrow 3Fe^{+3} + 3e.$$

The circulation requirements in the anolyte section of the cell are not as critically related to process performance as in the catholyte section; however, sufficient circulation is required to prevent local overoxidation and the attendant formation of chlorine gas. Circulation pump 30 withdraws anolyte from reservoir 28 through line 29. The anolyte is then introduced into the anolyte section of the electrolytic cell 32 through line 31. Overflow from the cell returns to anolyte reservoir 28 through line 33.

Oxidic type compounds of antimony present in the fresh feed concentrates are solubilized by neutralization reactions with the excess hydrochloric acid in the process solution. The subsequent recovery of metallic antimony from solution by electro-deposition would result in a net overoxidation of the solution in the regeneration stage, and loss of acid, unless compensating reactions are introduced. As indicated earlier in this description, hydrogen sulfide gas can be generated at a controlled rate in the second solution reduction stage 1 by reacting a portion of the sulfidic component of the raw feed with some of the excess hydrochloric acid in the process solution. The required amount of hydrogen sulfide gas is introduced into anolyte reduction unit 37 through line 39, whereby ferric iron is reduced as indicated in the equation:

$$2Fe^{+3} + H_2S \rightarrow 2Fe^{+2} + 2H^{+1} + S^0.$$

Continuous, prolonged, or extensive inclusion of oxidic compounds in the feed could require the external generation and addition of hydrogen sulfide, or some other appropriate, non-contaminating reducing agent, as opposed to reliance on internal generation in the second solution reduction stage 1. Compensating reactions need not be introduced if the production of chlorine gas as a by-product is desired, in which case the loss of hydrochloric acid could be compensated for by the addition of acid to the system.

Because of certain practical inefficiencies in the system, a pure antimony sulfide feed introduced into the system through line 2 could result in a small excess reduction potential for the system. This will not ordinarily occur in practice because of the presence of a certain amount of oxidic compounds of antimony contained in the feed, which provide excess oxidation potential as already discussed. However, should the composition of the feed result in a net excess reduction potential for the system, a compensating oxidation step can be added to the system. For example, the substantially regenerated solution leaving the electrolytic cell can be further oxidized by bubbling oxygen or an oxygen-containing gas such as air through the solution to further oxidize the ferrous chloride to ferric chloride, as shown by the equation:

$$4FeCl_2 + 0_2 + 4\ HCl \rightarrow 4FeCl_3 + 2H_2O.$$

It may be desirable to conduct this reaction under 40 – 50 p.s.i.g. to increase the reaction rate. However, the reaction will operate satisfactorily with either the cooled solution leaving the electrolytic cell (40° – 50° C.) or the heated solution to be introduced into the first solution reduction stage 54 (near atmospheric boiling). Thus, this oxidation step can be operated as a bleed stream off of the feed liquor reservoir 44, or this step can be inserted into the system at line 43, line 47, line 49, line 50, or at any other appropriate location in the system.

Anolyte is fed by metering pump 35 through line 34 to anolyte reduction unit 37 through line 36. The reaction slurry containing elemental sulfur suspended in reduced anolyte passes through line 38 to filter 40 where the elemental sulfur is separated from the reduced slution. The reduced solution is passed through line 41 and returned to anolyte reservoir 28.

The regenerated solution containing predominately ferric chloride, antimony (III) chloride, and hydrochloric acid passes through line 43 from anolyte reservoir 28 into the oxidation stage feed liquor reservoir 44. Since the first solution reduction stage 54 is preferably operated at the atmospheric boiling temperature, it is necessary to heat the regenerated solution which leaves the electrolytic cell at approximately 40°–50° C. To accomplish this, the feed liquor passes through line 45, circulating pump 46 and line 47 to heat exchanger 48 and then is returned through line 49 to reservoir 44.

The heated, regenerated solution is passed through lines 50 and 52 by metering pump 51 to another solution reduction stage, which is herein referred to as the "first solution reduction stage" and it is designated in the drawings by numeral 54. The partially reacted ore concentrate solids from solution-solids separations device 6 are introduced into the first solution reduction stage 54 through line 53. Elemental sulfur from filter 40 is inroduced through line 42 and excess hydrogen sulfide gas generated in the second solution reduction stage 1 and not consumed in anolyte reduction stage 37 is introduced through line 39. The first solution reduction stage 54 is substantially closed to the atmosphere, and the ferric chloride in the process solution reacts with the solids at near the atmospheric boiling point (105°) so as to essentially completely dissolve the antimony content therefrom.

The resultant slurry from the first solution reduction stage 54, containing elemental sulfur, insoluble residue, ferric chloride, ferrous chloride, antimony (III) chloride, and hydrochloric acid, is passed through line 55 to solution-solids separations device 56. In this device, gravity sedimentation is used to separate the insoluble residue and sulfur from the solution containing ferric chloride, ferrous chloride, antimony (III) chloride, and hydrochloric acid. The solution is passed through line 60 to water removal accumulator 62. The solids are removed from separator 56 through line 57 to a washing filter 58 where substantially all remaining process liquor is displaced. The filtered and washed solids, which include elemental sulfur and insoluble residues, are removed through line 59, and the recovered liquors are passed through line 61 to water removal accumulator 62.

The elemental sulfur passed out of the process through line 59 can be used as a raw material for the production of the hydrogen sulfide gas required in anolyte reduction unit 37 when oxidic antimony compounds are present in the feed concentrate.

If desired, the elemental sulfur can then be separated from the insoluble residue by heating the solids to a temperature at which the sulfur liquefies, followed by filtration.

Another procedure provides for the high temperature separation of the aqueous solution from the molten sulfur and insoluable residues during the first solution reduction stage 54. The temperature for gravity separation of the phases should be established above the melting point of sulfur (which is about 115° C), and safely below the temperature at which a rapid rise is the viscosity of the liquid sulfur occurs (which is about 159° C) to facilitate the decantation of the aqueous solution from the molten sulfur and insoluable residues. A temperature of approximately 140° C is recommended. Since atmospheric boiling for the first solution reduction stage 54 at atmospheric pressure is about 105° C, it becomes necessary to conduct the first solution reduction stage 54 in a suitable pressurized separation device to achieve the solution temperatures necessary to utilize this procedure. The molten sulfur, together with the insoluable residues, is withdrawn from the device. The still molten sulfur can be separated from the included solids, or the sulfur can be cooled below its melting point, causing it to crystallize, and be subsequently separated from the included solids. An advantage of this procedure is the accelerated reaction rates for the reactions of first solution reduction stage 54 resulting from the elevated operating temperature and pressure.

An important contribution of the hydrochloric acid in the process is to prevent the hydrolysis of the antimony chloride. The exact concentration at which hydrolysis occurs is somewhat dependent on solution composition and circuit temperature; however, laboratory data suggests that with minimum levels of hydrochloric acid (in the range of 2 – 5 percent) no difficulty is encountered.

Effective methods for monitoring and controlling the process of this disclosure have been developed. Measurement of the EH (oxidation-reduction potential) and pHE (hydrogen ion potential) of the process solution satisfactorily reveals the progress of the chemical reactions through the various steps of the process. Data derived from laboratory bench tests have revealed the following readings in Table I as typical for satisfactory process performance:

TABLE I

| Process Solution | EH: +mv[1] | pHE: +mv[1] |
|---|---|---|
| First Solution Reduction Stage Discharge | +330 | +440 |
| Second Solution Reduction Stage Discharge | +240 | +440 |
| Metal Recovery Stage (Catholyte) | +300 | +420 |
| Solution Regeneration Stage (Anolyte) | +640 | +420 |

[1]Reference Electrode Ag-$AgCl_2$

Similarly, laboratory tests were run to demonstrate the two solution reduction stages at about 105° C and at atmospheric pressure with active boiling under total reflux conditions. The pertinent data are tabulated below in Table II.

TABLE II

| Material | Reaction Time | % Sb Solubilized | Oxidation Potential In-mv | Oxidation Potential Out-mv |
|---|---|---|---|---|
| A. First Solution Reduction | | | | |
| Sb (metal) | 4 Hr. | 100.0 | +633 | +483 |
| $Sb_2S_3$ | 4 Hr. | 94.9 | +639 | +325 |
| B. Second Solution Reduction | | | | |
| $Sb_2S_3$ | 1 Hr. | 84.7 | +420 | +240 |
| $Sb_2O_3$ | 2 Hr. | 99.4 | +188 | +291 |

Generally, the reactions of the two solution reduction stages 1 and 54 proceed at a rapid enough rate to obviate the necessity of pressurizing these stages to decrease reaction time. However, it has been discovered that for certain oxidic compounds of antimony, such as stibiconite, it may be desirable to pressurize either one of the two solution reduction stages to reduce the time ncessary to solubilize these compounds. The degree to which one of the solution reduction stages is pressurized will depend upon the degree to which it is desired to reduce the corresponding reaction times. Also, it may be desirable to pressurize the first solution reduction stage to utilize the high temperature sulfur separation technique previously discussed.

It will be evident from the foregoing disclosures that the chemistry of the process technically requires no scheduled addition of reagents other than those which can be developed internally. Of course, with continuous, prolonged, or extensive inclusion of oxidic compounds in the feed stock, it is necessary to add an appropriate reducing agent, such as hydrogen sulfide, to the cycle at the anolyte reduction step. Practically however, the inventory of required reagents in the process solutions must be maintained by compensation for vapor or solution losses. Vapor losses, which may include hydrogen chloride and hydrogen sulfide, are held to a minimum by utilizing closed reaction vessels, reflux condensers, temperature controls, etc. Solution losses, aside from accidential spills, are essentially restricted to that associated with the solids discharged from the process. This can be controlled by washing. However, an economic balance will exist between the loss of values with the solids and the loading on the water removal system. The ions which are required for make-up of the process solutions are chloride and iron. Additional iron may be provided from any material or compound which can be solubilized in the process and which would not introduce interfering or undesirable contaminants. Materials which could be considered would include metallic iron, certain sulfides such as Pyrrhotite, or chemical salts such as ferric or ferrous chloride. Additional chloride ions may be introduced by chlorine gas, hydrochloric acid, or one of the iron chlorides, as examples.

The practice of this invention is not limited to the use of any special equipment. The stages and process steps described herein may be conducted on a batch or continuous basis, and in any appropriate conventional equipment, including for example, reactors, containers and vessels which may be made open or closed to the atmosphere by conventional means. Of course, closed vessels are desirable to minimize solution losses and pollutants. Moreover, each stage or step as described herein may be conducted in one or more reactors, vessels, or containers. Further, the use of available compartmented, divided, or segmented units of equipment is within the contemplation of this invention.

I claim:

1. A chemical, electro-chemical process for the production of metallic antimony comprising: a first solution reduction stage in which antimony-containing materials are oxidized in a solution containing ferric chloride and hydrochloric acid until there is substantial solubilization of the antimony content of the said materials in the form of antimony (III) chloride and reduction of part of the ferric chloride to ferrous chloride; a second solution reduction stage, separate from the first solution reduction stage, in which at least a substantial portion of the ferric chloride in the solution from the first solution reduction stage is reduced to ferrous chloride; and an electrolysis stage in which metallic antimony is recovered and ferric chloride is regenerated by electrolysis of the ferrous chloride solution from the metal recovery stage.

2. The process of claim 1 in which a substantial portion of the ferric chloride is reduced to ferrous chloride in the second solution reduction stage by reaction with antimony sulfide ore or ore concentrates.

3. The process of claim 2 in which the substantially reduced ferric chloride solution is further reacted with hydrogen sulfide in an amount required to reduce essentially all the ferric chloride to ferrous chloride, said hydrogen sulfide being formed in situ by the reaction of antimony sulfide containing materials with a portion of the excess hydrochloric acid in the solution.

4. The process of claim 3 in which formation of hydrogen sulfide by reaction of antimony sulfide containing materials with a portion of the hydrochloric acid in the solution is obtaned by introducing antimony sulfide containing materials until an excess quantity above and beyond that required to reduce essentially all the ferric chloride to ferrous chloride is produced in the second solution reduction stage.

5. The process of claim 4 in which the excess hydrogen sulfide is used to partially reduce the ferric chloride in the electrolysis step to prevent overoxidation.

6. The process of claim 4 in which the excess hydrogen sulfide is reacted with liquor in the first solution reduction stage to reduce the loss of hydrogen sulfide vapor.

7. The process of claim 2 in which the first solution reduction stage is conducted on materials which include antimony sulfide ore or ore concentrates previously reacted with ferric chloride in the second solution reduction stage.

8. The process of claim 1 in which the reaction temperature in the first solution reduction stage is maintained in the range from about 115° C to about 159° C.

9. The process of claim 8 in which the reaction temperature in the first solution reduction stage is maintained at about 140° C.

10. The process of claim 9 in which the second solution reduction stage is conducted at a reaction temperature of about 105° C, with said reduction stage closed to the atmosphere to minimize loss of chloride vapor, whereby substantial reduction of the ferric chloride to ferrous chloride is achieved with minimal loss of antimony from the solution.

11. The process of claim 10 in which the first solution reduction stage is conducted on materials containing partially reacted stibnite ore or ore concentrates from the second solution reduction stage.

12. The process of claim 10 in which the substantially reduced ferric chloride solution is further reacted with materials containing metallic antimony to form ferrous chloride.

13. The process of claim 1 in which excess water in the process solution is removed by distillation to minimize dilution.

14. The process of claim 13 in which the hydrogen chloride content of the water removed by distillation is substantially reduced by fractionation, such fractionation being accomplished by the use of controlled reflux and contacting devices such as packed columns.

15. The process of claim 14 in which a portion of the concentrated process solution stream leaving the water removal system is available for treatment to remove undesirable soluble contaminants prior to returning it to the main process stream.

16. The process of claim 1 in which a portion of the ferric chloride in the regenerated ferric chloride solution is reduced or partially reduced by contacting with a reducing gas.

17. The process of claim 16 wherein the said reducing gas is hydrogen sulfide.

18. The process of claim 17 in which a substantial portion of the elemental sulfur formed is removed from the process circuit as a product.

19. The process of claim 1 in which said antimony-containing materials consist primarily of antimony mixed oxide - sulfide ores or ore concentrates.

20. The process of claim 19 in which additional hydrochloric acid is added to the system and the formation of free chlorine gas is obtained in the electrolysis stage.

21. The process of claim 1 in which said antimony-containing materials consist primarily of antimony oxide ores or ore concentrates.

22. The process of claim 21 in which additional hydrochloric acid is added to the system and the formation of free chlorine gas is obtained in the electrolysis stage.

23. The process of claim 1 in which the hydrochloric acid content is maintained in the solution throughout the process at a concentration above that required to avoid precipitation of any antimony chloride in solution by hydrolysis.

24. The process of claim 23 in which said second solution reduction stage is conducted in three steps, comprising:

a. a first step in which antimony containing materials are introduced in an amount insufficient to reduce all of the ferric chloride to ferrous chloride, b. a second step in which the solution from the first step is reacted with hydrogen sulfide gas to reduce essentially all of the ferric chloride to ferrous chloride and to precipitate arsenic sulfide, and c. a third step in which the solution from the second step is contacted with antimony sulfide containing materials to react a portion of the antimony sulphide content of said material with the excess hydrochloric acid to produce hydrogen sulfide gas.

25. The process of claim 1 in which the reaction temperature in the first solution reduction stage is maintained at about 105° C.

26. The process of claim 25 in which the first solution reduction stage is closed to the atmosphere to minimize the loss of vapor.

27. The process of claim 1 in which the reaction temperature in the first solution reduction stage is maintained above the melting point of sulfur and below the temperature at which the viscosity of sulfur rises abruptly, in order to accelerate the reaction rate to produce a reaction slurry containing sulfur released from the sulfide ore concentrates essentially in elemental form.

28. The process of claim 27 in which the sulfur in the final reacted slurry of the first solution reduction stage is crystallized by cooling the slurry to a temperature below the melting point of sulfur so as to cause the crystallization of the sulfur into a form that will improve subsequent liquid-solids separation.

29. The process of claim 27 in which the finally reacted slurry of the first solution reduction stage is subjected to a phase separation, said phase separation comprising separating the aqueous solution, which includes the antimony chloride, from the molten sulfur and the insoluble residues, and thereafter further separating the insoluble residues from the molten elemental sulfur.

30. The process of claim 1 in which the metallic antimony produced at the cathodes is not more than about one half on the antimony in solution feed to the electrolytic cells to reduce the possibility of formation of hydrogen and/or stibine gases at the cathode.

31. The process of claim 30 in which the solution in contact with the anodes in the electrolytic cells is maintained physically separated from the solution in contact with the cathodes by diaphragms formed of material substantially inert to the environment of the electrolysis and having limited permeability to hydraulic flow together with minimal electrical resistance, and in which each said solution is separately mixed to maintain homogeneity.

32. The process of claim 1 in which a portion of the ferrous chloride is oxidized to ferric chloride by use of oxygen or oxygen-containing gases.

33. The process of claim 32 in which the oxygen-containing gas is air.

34. The process of claim 1 wherein the product antimony metal is oxidized in the presence of oxygen or oxygen-containing gases to form antimony oxide as a product.

35. The process of claim 34 in which the oxygen-containing gas is air.

36. The process of claim 1 in which a substantial portion of the ferric chloride is reduced to ferrous chloride in the second solution reduction stage by reaction with antimony-containing materials.

37. The process of claim 1 in which said antimony-containing materials consist primarily of metallic antimony.

38. The process of claim 1 in which the hydrochloric acid content is maintained in the solution throughout the process in a concentration sufficient to avoid loss by hydrolysis of any antimony chloride in the solution.

39. The process of claim 1 in which the reduced antimony chloride containing solution is electrolyzed at a temperature in the range between about 30° C and 60° C.

40. The process of claim 1 in which the reaction temperature in the second solution reduction stage is maintained at below the atmospheric boiling temperature but above 40° C.

41. The process of claim 1 in which the reaction temperature in the first solution reduction stage is maintained at below the atmospheric boiling temperature but above 40° C.

42. A chemical, electro-chemical process for the recovery of electrolytic antimony from antimony-containing materials, such as antimony ore concentrates containing sulfides or mixtures thereof with antimony oxides or metallic antimony, comprising a reduction stage into which said antimony-containing materials are introduced into a solution containing hydrochloric acid and ferric chloride to solubilize a part of the antimony in said antimony-containing materials in the form of antimony (III) chloride and to reduce essentially all of said ferric chloride in said solution to ferrous chloride and to form additionally hydrogen sulfide gas with concurrent solubilization of additional antimony values in the form of antimony (III) chloride; an antimony recovery stage in which the antimony chloride solution from said reduction stage is electrolyzed in an electrolytic cell to produce metallic antimony at the cathodes and to regenerate ferric chloride at the anodes; a ferric chloride reduction step in closed circuit with the ferric chloride regeneration step of said antimony recovery stage to prevent overoxidation of the process solution; and an additional solution reduction stage in which the solids from the other solution reduction stage are introduced into the solution leaving the electrolytic cell to solubilize essentially all remaining antimony in the solids in the form of antimony (III) chloride in solution; and recycling the resulting solution containing ferric chloride to said other solution reduction stage.

43. The process of claim 42 in which said antimony-containing materials include impure antimony metal to be processed for the production of electrolytic grade material.

44. The process of claim 42 in which said antimony-containing materials include scrap antimony metal.

45. A cyclic chemical, electro-chemical process for the production of metallic antimony comprising:

A. Introducing materials containing principally stibnite ore or concentrates thereof into a solution containing ferric chloride and hydrochloric acid at a temperature of at or slightly below the atmospheric boiling temperature of 107° C but not below 40° C in containers essentially closed to the atmosphere for such a period of time as to achieve substantial solubilization of the antimony content of the materials, thereby forming a solution containing antimony (III) chloride, ferric chloride and ferrous chloride.

B. Essentially reducing the ferric chloride in the solution from step (A) by reaction of the solution with materials containing fresh stibnite ore or concentrate in containers essentially closed to the atmosphere at about the atmospheric boiling point of 107° C, but not below 40° C.

C. Continuing to contact the reacting slurry from step (B) to complete the reduction of the ferric chloride in solution and to promote the production of hydrogen sulfide, thereby forming a feed solution for electrolysis containing ferrous chloride, antimony (III) chloride and hydrochloric acid.

D. Electrolyzing the solution from step (B) or step (C) in the catholyte compartment of a diaphragm equipped electrolytic cell to produce metallic antimony at the cathode.

E. Electrolyzing the solution from step (D) in the anolyte compartment of the diaphragm equipped electrolytic cell to regenerate the ferric chloride in the solution.

F. Withdrawing a portion of the anolyte solution and reacting it with a reducing gas such as hydrogen sulfide to partially reduce the ferric chloride in solution, thereby preventing overoxidation of said solution, and reintroducing the partially reduced solution into the circulating anolyte stream.

G. Returning the solution from step (F) to step (A), thus completing the cyclic process loop.

* * * * *

UNITED STATES PATENT AND TRADEMARK OFFICE

CERTIFICATE OF CORRECTION

PATENT NO. : 3,986,943

DATED : October 19, 1976

INVENTOR(S) : Frank E. Lamb

It is certified that error appears in the above-identified patent and that said Letters Patent are hereby corrected as shown below:

Column 1, line 54, "the prior at" should read--the prior art--.
Column 2, line 5, "electrolytic hydrometallurgical" should read--electrolytic, hydrometallurgical--;
line 20, "prsent" should read--present--;
line 41, "solution present stage" should read--solution reduction stage--;
line 43, "metallic" should read--containing--.
Column 3, line 10, "requuired" should read--required--.
Column 4, line 40, "metal the" should read--metal, the--.
Column 5, line 5, "ncessary" should read--necessary--;

Column 6, lines 21-22, "electrolytic" should read--sheets,--;
line 45, "line 2" should read--line 22--.
Column 8, line 8, "slution" should read--solution--;
line 29, "inroduced" should read--introduced--.
Column 10, line 6, "ncessary" should read--necessary--;

Column 11, line 32, "obtaned" should read--obtained--.

Signed and Sealed this

Tenth Day of May 1977

[SEAL]

*Attest:*

RUTH C. MASON
*Attesting Officer*

C. MARSHALL DANN
*Commissioner of Patents and Trademarks*